United States Patent [19]

Brasket

[11] Patent Number: 4,862,333

[45] Date of Patent: Aug. 29, 1989

[54] CORNER WALL LAMP

[76] Inventor: Denis R. Brasket, 2745 Winnetka Ave. North - #185, Golden Valley, Minn. 55427

[21] Appl. No.: 225,793

[22] Filed: Jul. 29, 1988

[51] Int. Cl.[4] ..... F21S 1/02

[52] U.S. Cl. ..... 362/147; 362/294; 362/373; 362/307; 362/455

[58] Field of Search ..... 362/145, 147, 125, 126, 362/151, 432, 294, 373, 368, 806, 311, 307, 433, 455

[56] References Cited

U.S. PATENT DOCUMENTS 4,217,629 8/1980 Russell ..... 362/147

4,338,653 7/1982 Marrero ..... 362/147

4,352,151 9/1982 Lewis ..... 362/147

4,569,003 2/1986 Elmer et al. ..... 362/147

*Primary Examiner*—Ira S. Lazarus

*Assistant Examiner*—D. M. Cox

*Attorney, Agent, or Firm*—Herman H. Bains

[57] ABSTRACT

A corner lamp is attached to the corner of a room defined by the orthogonal relation of two adjoining walls and the ceiling of a room. The lamp is of tetrahedral configuration and includes a frame comprised of a rectangular central panel and a pair of triangular side panels. The central panel has a light bulb assembly mounted thereon and a triangular lens is mounted on the frame between the triangular side panels.

8 Claims, 2 Drawing Sheets

CORNER WALL LAMP

This invention relates to lamps and, more particularly, to wall lamps.

BACKGROUND OF THE INVENTION

Interior illumination for commercial and domestic buildings is provided by various types of lighting devices. Wall and ceiling lamps are sometimes used, but placement of these prior art wall or ceiling attached lamps does not always provide efficient illumination or aesthetic appeal. Wall lamps, as the name suggests, are mounted on a room wall, but are not usually attached at a corner. There are presently no known commercial corner lamps which may be mounted where the apex of two walls meets the ceiling.

SUMMARY OF THE INVENTION

It is an object of this invention to provide a novel corner lamp, which is designed to be mounted in the corner of a room where two walls meet the ceiling to thereby present an aesthetically appealing lamp and one which permits efficient distribution of the light.

A more specific object of this invention is to provide a novel corner wall lamp of tetrahedral configuration comprising a metal frame and a triangular lens which, when mounted in a room corner at the ceiling, permits effective diffusion of light therefrom.

Another object of this invention is to provide a novel corner wall lamp of tetrahedral configuration, including a metal frame, which engages a pair of orthogonally disposed walls and ceiling, and which is provided with a flap that overlies the light bulb to protect the ceiling from excessive heat input.

A further object of this invention is to provide a corner wall lamp of tetrahedral configuration, including a triangular-shaped lens mounted on a metal frame comprised of a pair of triangular-shaped side panels and a central panel which provides a space at the room corner behind the frame. The central panel has several functions, namely: it spaces the frame away from the wall corner to allow installation of the frame upon walls in which the corner may be appreciably rounded, rather than square; it provides a mounting surface for a socket; and the space behind the panel permits routing the electrical wiring behind the panel, thereby shielding the wiring from the heat of the bulb.

These and other objects will be more fully defined in the following Specification.

FIGURES OF THE DRAWING

DESCRIPTION OF THE PREFERRED EMBODIMENT

Figure 1:
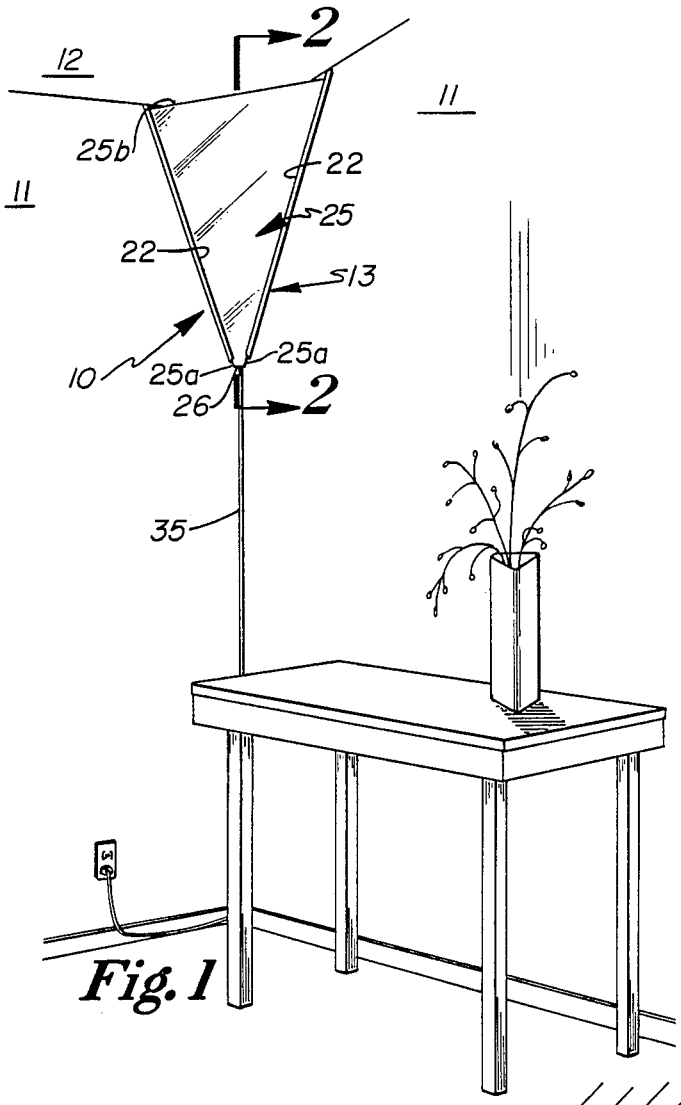
FIG. 1 is a perspective view of the novel corner wall lamp illustrated in mounted relation in a room corner.
Figure 3:
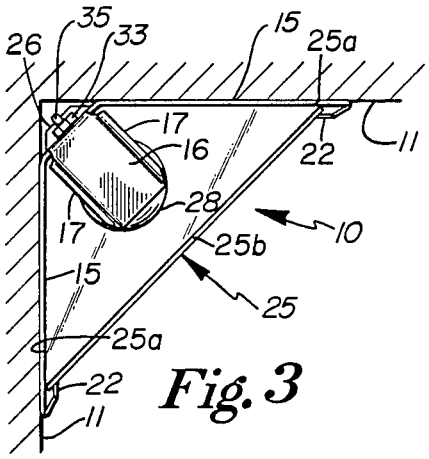
FIG. 3 is a top view taken approximately along the line 3—3 of FIG. 2 and looking in the direction of the arrows.
Figure 2:
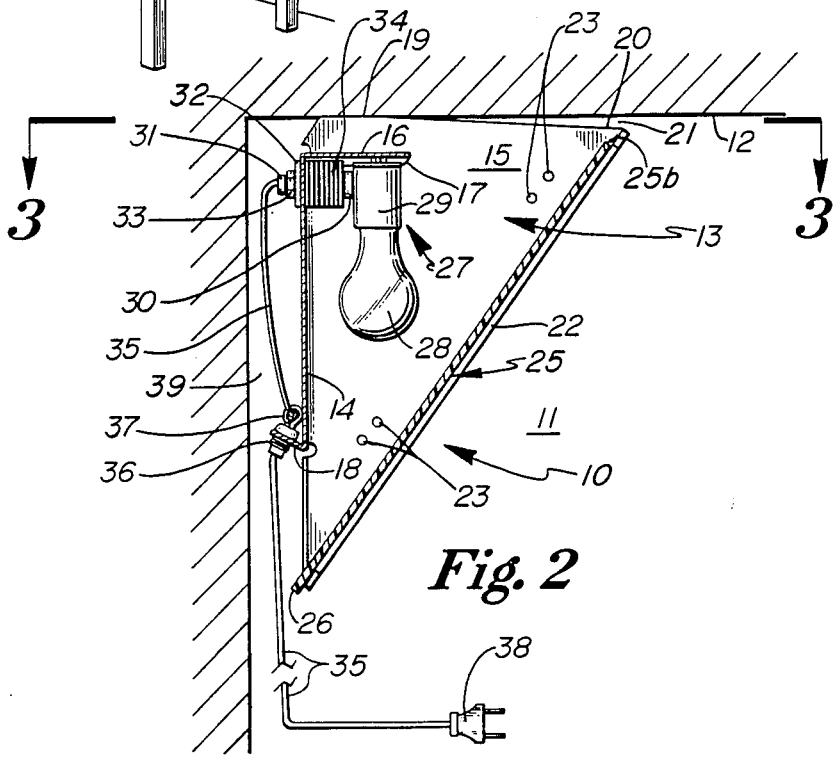
FIG. 2 is a cross-sectional view taken approximately along the line 2—2 of FIG. 1 and looking in the direction of the arrows.

Referring now to the drawings and, more specifically, to FIGS. 1, 2, and 3, it will be seen that one embodiment of the novel corner lamp, designated generally by the reference numeral 10, is there shown. It will be noted that the corner lamp 10 is mounted in the corner of a room at the apex where two walls 11 meet at the ceiling 12. In the preferred embodiment of the novel corner lamp, it is assumed that the walls 11 and ceiling 12 are arranged in orthogonal relationship with respect to each other. However, it is pointed out that the design of the corner lamp may be modified for use in conjunction with walls and ceilings that do not necessarily meet at 90-degree angles.

It will be seen that the volumetric space defined by the novel lamp 10 defines a tetrahedron. In this respect, if a skewed plane intercepts three other mutually intersecting planes, such intersection creates four triangles which define and bound a pyramidal volume, i.e., spatially, a tetrahedron. All four sides of this volumetric space are triangles: one on each wall, one triangle comprising the corner of the ceiling, and one triangle facing into the room.

Referring again to FIGS. 1, 2, and 3, it will be seen that the novel corner lamp 10 includes a frame 13 formed of a heat-resistant and reflective lightweight material, such as white-enameled aluminum, or other similar materials. The frame 13 includes a generally rectangularly-shaped central panel 14 having a pair of similar triangular-shaped side panels 15 integrally formed therewith and extending outwardly therefrom. When the lamp 10 is mounted in the corner, the triangular side panels lie flat upon both walls. The central panel 14 is also spaced from the corner defined by the orthogonally related walls.

The central panel 14 has an upper flap 16 integrally formed therewith and extending forwardly in right angular relation thereto. The upper flap 16 has flanges 17 integral therewith and extending downwardly therefrom. The lower end portion of the central panel 14 has a flap 18 integrally formed therewith and extending rearwardly therefrom. It is pointed out that the flap 18 has an opening therethrough for passage of electrical wiring. The upper flap 16 deflects heat energy radiated directly upwardly by the lamp bulb and socket, which prevents damage or discoloration of the ceiling from excessive heat input.

Referring now to FIG. 2, it will be seen that the triangular side panels have an upper edge 19 which engages the ceiling 12 along a portion of its length. However, it will be noted that the upper edge 19 has a slightly downwardly extending front portion 20 that defines an opening 21 between the top of the lens 25*b* and the ceiling 12. This allows the circulation of heated air and thereby prevents overheating of the ceiling and lamp. The dimension of the clearance 21 is dependent upon the size of the lamp and the size of the maximum light bulb properly associated therewith. Each lamp size has a specified maximum wattage lamp bulb to be used in each lamp, and such maximum size is prominently marked by decal or stencil on each lamp. The clearance afforded by dimension 21, in conjunction with proper triangle size, is built into each lamp and includes a large safety factor for the kind of misuse which may be expected in service, namely, use some times of larger than specified bulbs. The safety factor is such that no deterioration of the socket or wiring will occur in the event of misuse, but is such that for gross misuse the triangle will visibly deform. The clearance is typically one inch, being somewhat more than one inch for larger wattage lamps and less than one inch for smaller wattage lamps.

Each triangular side panel 15 has an inturned flange 22 integral therewith and converging towards the inturned flange on the other side panel, as best seen in FIG. 1. It will also be noted in FIGS. 2 and 3 that the side flanges 22 extend downwardly and inwardly towards the associated corner. The side panels are provided with a plurality of small openings 23 therethrough for accommodating small nails, which are used to secure the side panels to the associated walls 11.

A triangular-shaped lens 25 formed of a rigid translucent material, having suitable optical properties, is engaged by the frame so that the inclined side edges 25*a* of the lens 25 engage the side panels and are supported by flanges 22. When the lens 25 is mounted on the frame, the edge portions 25*a* of the lens tend to urge the side panels 15 against the associated wall 11. It will be noted that the upper edge 25*b* of the lens 25 is spaced by the dimension 21 below the surface of the ceiling 12 when the lens is in supported relation on the frame 13. The lower end portion of the lens 25 is truncated, as at 26. The clearance 21 between the upper edge 25*b* and the ceiling permits the outflow of hot air and also allows one to remove the lens in order to change the light bulb. This clearance also permits some indirect lighting as a result of reflection of light outwardly through the clearance opening into the room, thereby enhancing the total light efficiency.

Referring again to FIG. 2, it will be seen that the tetrahedral lamp 10 is provided with an incandescent light bulb assembly 27 which is secured to the central panel 14. The incandescent light bulb assembly includes an incandescent light bulb 28 of predetermined desired wattage which is threaded into a female socket member 29. In this regard, the socket member 29 is a suitable heat-resistant commercial model, which is selected to tolerate operating temperatures without degradation. The socket member 29 is provided with an internally threaded sleeve 30 that threadedly engages a nipple 31, which projects through an opening in the central panel 14. A washer 32 and nut 33 secure the incandescent light bulb assembly 27 to the central panel. In the embodiment shown, a plurality of spacers 34 are disposed between the internally threaded sleeve 30 and the front surface of the central panel 14 to properly position the light bulb for optimum results. It will also be noted that the length of the flap 16 is of a magnitude related to the thickness of the spacer stack 34 so that the flap overlies light bulb 28 and socket 29.

The incandescent light bulb assembly 27 also includes a two-wire cord 35 which extends downwardly through the space 39 defined behind the central panel 14. The two-wire cord 35 is formed into a knot 37, which engages a grommet 36 positioned within the opening in the rearwardly extending flap 18. The cord 35 extends through the opening and is provided with a conventional two-prong or three-prong male connector 38 at its other end for ready connection to a conventional outlet. The knot 37 prevents stress or force applied to the dangling cord from being transmitted to the wire connected within the lamp socket, as is customary in lamp design. The clearance space 39 behind the central panel 14 not only allows the cord 35 to pass downwardly behind the lamp frame, protected from the bulb heat, but also allows the installation of the lamp at corners which are not truly orthogonally related.

Figure 4:
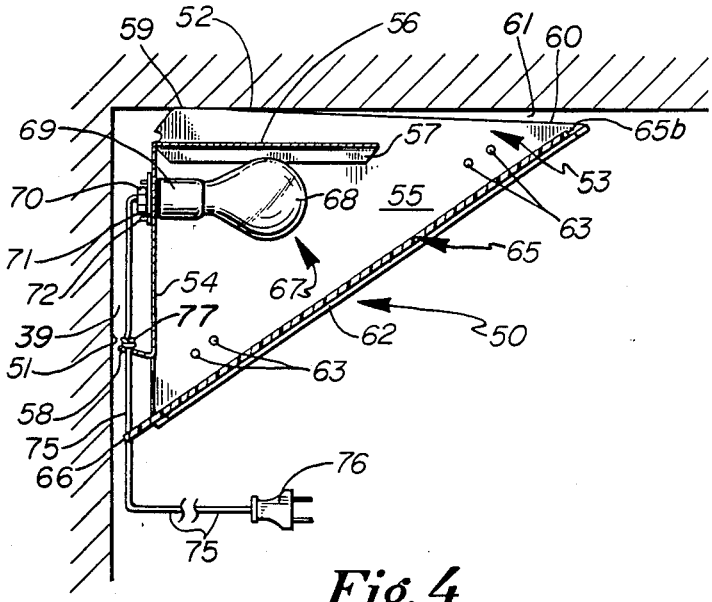
FIG. 4 is a cross-sectional view of a modified form of the novel lamp and corresponding generally to FIG. 2.
Figure 5:
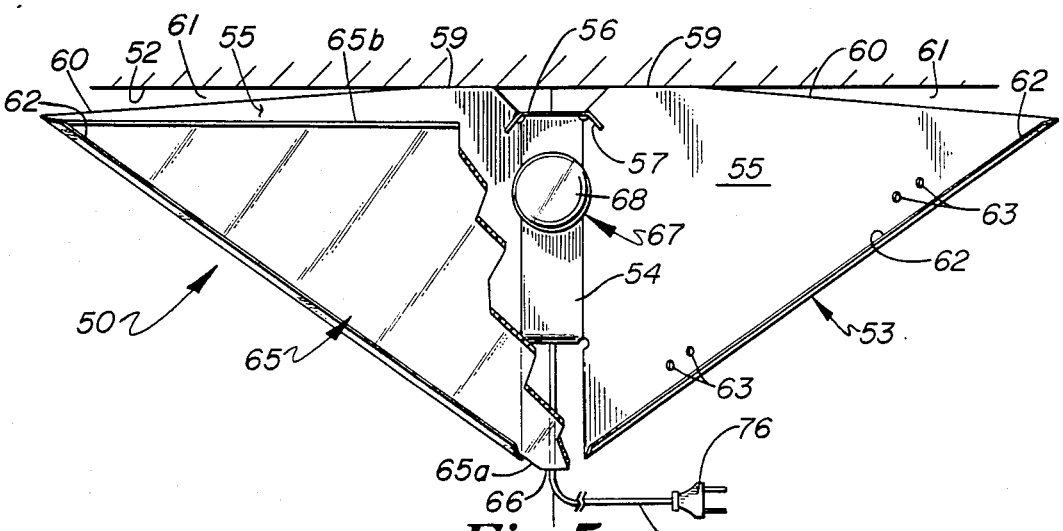
FIG. 5 is a front elevational view of the lamp illustrated in FIG. 4 with the lens partially broken away.
Figure 6:
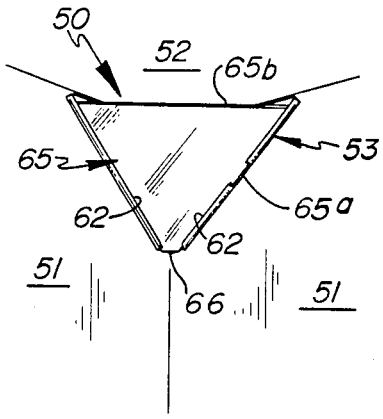
FIG. 6 is a front perspective view of the lamp illustrated in FIG. 4.

Referring now to FIGS. 4, 5, and 6, it will be seen that a modified form of the novel tetrahedral lamp is thereshown and is designated generally by the reference numeral 50. The tetrahedral lamp 50 is also attached to orthogonally disposed walls 51 at their intersection with the ceiling 52. The lamp 50 includes a frame 53, which is comprised of a generally rectangular-shaped central panel 54 having a pair of similar triangular-shaped side panels 55 integrally formed therewith and projecting therefrom. The central panel 54 has an upper flap 56 integrally formed therewith and projecting forwardly at right angles relative thereto. The flap 56 is provided with downturned flanges 57, as best seen in FIG. 5. The lower end portion of the central panel 54 is bent rearwardly and upwardly to define an upturned flap 58 having an opening therein.

The upper flap 56 of the central panel 54 also serves as a shield to prevent heat from the incandescent light from being radiated upwardly and causing damage or discoloration to the ceiling. It is also pointed out that, while both embodiments of the lamp described hereinabove have included protective flaps or shields to prevent damage to the ceiling, the flap may be omitted by mounting the incandescent lamp assembly at a lower location with respect to the frame.

Each of the side panels 55 is provided with an upper edge 59, which engages the ceiling 52. Again, it will be noted that the front portion of each upper edge is downwardly declined, as at 60, to define a space or opening 61 between the ceiling and the top of the lens 65*b*. This space 61 allows hot air to escape from the interior of the lamp and prevents overheating. It is again pointed out that the exact dimension of this downwardly extending front portion will be dependent on the wattage of the bulb used. The side panels 55 are also each provided with an inturned flange 62 and these flanges converge inwardly in the manner of the embodiments of FIGS. 1, 2, and 3. Each side panel also has a plurality of small openings 63 therein for accommodating nails, which secure the side panels to the walls.

The lamp is provided with a generally triangular-shaped translucent lens 65 formed of material of suitable mechanical, thermal, and optical properties. The inclined side edges 65*a* of the lens engage the side panels 55 of the frame and urge the side panels against the vertical walls of the room. The lower end portion of the lens is truncated, as at 66, and it will be noted that the upper edge 65*b* of the lens is spaced slightly from the ceiling 52. This clearance 61 between the ceiling and the upper edge of the lens is necessary to permit the outflow of hot air, the removal of the lens when it is desirable to replace a bulb, and permits some indirect lighting. With respect to indirect lighting, some of the light is reflected outwardly to the room from the ceiling without passing through the lens.

The tetrahedral lamp 50 also includes an incandescent light bulb assembly 67 and an incandescent light bulb 68 of the desired wattage. It will be noted that the light bulb assembly 67 also includes a commercial socket member 69, which is internally threaded for accommodating the light bulb 68. The socket member 69 is a commercial type and is heat-resistant in the manner of the embodiment of FIGS. 1, 2, and 3 for operating at selected temperatures without degradation.

Means are provided for securing the socket member to the central panel 54. In this regard, the socket member 69 is provided with a pair of bolts 72 which pass through openings in the central panel and threadedly engage in threaded bores in a flange 71, which is integral with a sleeve 70. The sleeve 70 is disposed in registering relation with an opening in the central panel 54 through which the two-wire cord extends. The flange 71 and bolts 72 clamp the socket member against the front surface of the panel 54. The incandescent light bulb assembly includes a two-wire cord 75, which is provided with a male connector 76, at its other end. The male connector may be either the two-prong or three-prong type, as desired for connection to a conventional wall outlet. The two-wire cord 75 has a knot 77 tied therein, which engages the flap 58 as the cord passes through the opening in the latter. The knot 77 prevents stress or force applied to the dangling cord from being transmitted to the wire connected within the lamp socket. A grommet is provided at the opening in the flap 58. The detail of this grommet in flap 58 is identical to the grommet 36 in flap 18 in FIG. 2.

By way of comparison, it will be noted that the lamp illustrated in FIGS. 1, 2, and 3 has a greater ratio of verical dimension to width, while the converse is true with respect to the lamp disclosed in FIGS. 4, 5, and 6. In this regard, dimensions referred to are the height and width of the triangular lens, as viewed in planform. The width dimension is the width of the upper edge of the triangular lens. The vertical dimension is the height of the lens, measured prior to truncation of the lower tip of the triangle.

The two configurations shown feature either vertical or horizontal mounting of the light bulb, based upon the value of the rato as defined above. If the height-to-width ratio is greater than 0.8, the included bulb is mounted vertically, as shown in the lamp embodiment 10 in FIGS. 1, 2, and 3. If the height-to-width ratio of the triangular lens is less than 0.8, the included bulb is mounted horizontally, as shown in the lamp embodiment 50 in FIGS. 4, 5, and 6. This differentiation, based on a ratio of 0.8, provides the best spatial accommodation of standard size incandescent light bulbs within the enclosed volume. Consequently, a wide range of efficient lamp configurations may be provided, varying in size so as to accommodate large or small bulbs, and varying in height-to-width ratio as desired, either for reason of space availability or for reason of aesthetic choice. Each configuration will spatially define a tetrahedron.

It will be seen that my novel corner lamp, while having a general tetrahedral shape, may vary otherwise in size and configuration. It will also be noted that my novel corner lamp may be readily mounted in a corner at the ceiling, regardless of whether the walls have a perfect or imperfect orthogonal relationship.

It will also be seen from the preceding paragraphs and the attached FIGS. 1–6 that my novel tetrahedral lamp is not only effective in providing good efficient light distribution, but it is also highly aesthetically appealing to the eye.

Thus, it will be seen that my novel tetrahedral lamp is not only of simple and inexpensive construction, but one which functions in a more efficient manner than any heretofore known comparable lamp, as a consequence of unique and original utilization of an aspect of a room geometry.

What is claimed is:

1. A tetrahedral corner lamp for attachment to the corner of a room defined by the orthagonal relation of a pair of walls and the ceiling of the room, comprising:

a metal frame formed of a heat resistant, light reflective material and including a generally rectangular-shaped vertically extending central panel and a pair of triangular-shaped side panels integral with said central panel and extending angularly outwardly therefrom, means of attaching the triangular side panels to the associated vertical walls defining the corner, said triangular side panels each having an upper edge with a portion thereof engaging the ceiling and having a front outer edge bent to define an inturned flange, said inturned flange on one side panel inclined towards the inturned flange on the other side panel, a light bulb socket connected with said central panel and projecting forwardly therefrom between said triangular side panels, a light bulb mounted in said socket, an elongate two-wire electrical cord having one end thereof connected to said socket and extending downwardly therefrom and having a male socket member secured to the other end thereof for connection to an electrical outlet, said triangular side panels and said central panel defining reflective surfaces for reflecting light outwardly of said frame, and a triangular-shaped translucent lens positioned between said side panels in contact therewith having an apex extending downwardly, engaging and supported by said flanges and urging each of said triangular side panels against the adjacent associated vertical wall.

2. The tetrahedral lamp as defined in claim 1 wherein said upper edge of each triangular side panel includes a relieved portion which defines a lens-to-ceiling clearance opening with respect to the ceiling when the upper edge engages the ceiling.

3. The tetrahedral lamp as defined in claim 1 wherein said lens has a substantially straight upper edge spaced downwardly from the ceiling.

4. The tetrahedral lamp as defined in claim 3 wherein the bulb is mounted vertically for lamps with a lens having a height-to-width ratio greater than 0.8.

5. The tetrahedral lamp as defined in claim 3 wherein the bulb is mounted horizontally for lamps with a lens having a height-to-width ratio less than 0.8.

6. The tetrahedral lamp as defined in claim 1 wherein said central panel of said metal frame is of such as rectangular shape that it will extend at an angle across the corner of a room between adjoining walls on which said side panels are mounted, whereby said central panel will be spaced outwardly from the room corner and define therewith a triangular space between the wall and metal frame within which said electrical cord may extend downwardly.

7. A tetrahedral corner lamp for attachment to the corner of a room defined by the orthagonal relation of a pair of walls and the ceiling of the room, comprising:

a metal frame including a generally rectangular-shaped central panel and a pair of triangular-shaped side panels integral with said central panel and extending angularly outwardly therefrom, means for attaching the triangular side panels to the associated vertical walls defining the corner, said triangular side panels each having an upper edge with a portion thereof engaging the ceiling and having a front outer outermost edge bent to define an inturned flange, said inturned flange on one side panel inclined and angled towards the inturned flange on the other side panel, a light bulb socket connected with said central panel and projecting forwardly therefrom between said triangular side panels, said socket being spaced downwardly from the ceiling, an elongate two-wire electrical cord having one end thereof connected to said socket and extending downwardly therefrom and having a male socket member secured to the other end thereof for connection to an electrical outlet, and a triangular-shaped translucent lens positioned between said side panels in contact therewith having an apex extending downwardly and engaging and being supported by said flanges and urging each of said triangular side panels against the adjacent associated vertical wall.

8. A tetrahedral corner lamp for attachment to the corner of a room defined by the orthagonal relation of a pair of walls and the ceiling of the room, comprising:

a metal frame including a generally rectangular-shaped central panel and a pair of triangular-shaped side panels integral with said central panel and extending angularly outwardly therefrom said central panel having a horizontally disposed flap integral therewith and projecting forwardly therefrom, means for attaching the triangular side panels to the associated vertical walls defining the corner, said triangular side panels each having an upper edge with a portion thereof engaging the ceiling and having a front outer edge bent to define an inturned flange, said inturned flange on one side panel inclined towards the inturned flange on the other side panel, a light bulb socket connected with said central panel and projecting forwardly therefrom between said triangular side panels, said horizontal flap overlying and shielding a light bulb installed in said socket and being of such dimensions to intercept heat energy radiated by the light bulb and to prevent damage to the ceiling, said socket being spaced downwardly from the ceiling, an elongate two-wire electrical cord having one end thereof connected to said socket and extending downwardly therefrom and having a male socket member secured to the other end thereof for connection to an electrical outlet, and a triangular-shaped translucent lens positioned between said side panels in contact therewith having an apex extending downwardly and engaging said flanges and urging each of said triangular side panels against the adjacent associated vertical wall.

* * * * *